US008023807B2

(12) United States Patent
Knoeppel et al.

(10) Patent No.: US 8,023,807 B2
(45) Date of Patent: Sep. 20, 2011

(54) RESISTOR ANODE ASSEMBLY

(75) Inventors: Ray O. Knoeppel, Hartland, WI (US); Mark Allan Murphy, Nashville, TN (US)

(73) Assignee: AOS Holding Company, Wilmington, DE (US)

( * ) Notice: Subject to any disclaimer, the term of this patent is extended or adjusted under 35 U.S.C. 154(b) by 734 days.

(21) Appl. No.: 12/013,776

(22) Filed: Jan. 14, 2008

(65) Prior Publication Data

US 2009/0179025 A1 Jul. 16, 2009

(51) Int. Cl.
*F24H 1/20* (2006.01)
*H05B 3/78* (2006.01)

(52) U.S. Cl. ..... 392/457; 392/441

(58) Field of Classification Search ..... None
See application file for complete search history.

(56) References Cited

U.S. PATENT DOCUMENTS

| | | | |
|---|---|---|---|
| 2,453,865 | A | 11/1948 | Schmidt |
| 2,486,871 | A | 11/1949 | Osterheld |
| 2,568,594 | A | 9/1951 | Robinson |
| 2,616,844 | A | 11/1952 | Klumb |
| 2,656,314 | A | 10/1953 | Osterheld |
| 2,666,027 | A | 1/1954 | Vallett |
| 2,740,757 | A | 4/1956 | Craver |
| 2,748,250 | A | 5/1956 | Andrus |
| 2,779,729 | A | 1/1957 | Jorgensen |
| 2,934,485 | A | 4/1960 | Sabins |
| 2,999,800 | A | 9/1961 | Reeside |
| 3,037,920 | A | 6/1962 | Vixler |
| 3,412,358 | A | 11/1968 | Hummel et al. |
| 3,469,226 | A | 9/1969 | Solow |
| 3,542,663 | A | 11/1970 | Alewitz |
| 3,718,573 | A | 2/1973 | Bidwell |
| 3,891,530 | A | 6/1975 | Alewitz |
| 4,035,903 | A | 7/1977 | Taggart |
| 4,093,529 | A | 6/1978 | Strobach |
| 4,486,288 | A | 12/1984 | Linder |
| 4,786,383 | A | 11/1988 | Houle |
| 4,848,616 | A | 7/1989 | Nozaki |
| 5,256,267 | A | 10/1993 | Roden |
| 5,334,299 | A | 8/1994 | Roden |
| 5,335,311 | A | 8/1994 | Groothuizen |
| 6,998,031 | B1 | 2/2006 | Hill |
| 7,017,251 | B1 | 3/2006 | Murphy |
| 7,186,321 | B2 | 3/2007 | Benham |

OTHER PUBLICATIONS

Chinese Patent Office Action for Application No. 200810128800.6 dated Dec. 21, 2010 (6 pages).
Chinese Patent Office Action for Application No. 200810128800.6 dated Jun. 9, 2011 (3 pages).

*Primary Examiner* — Thor S Campbell
(74) *Attorney, Agent, or Firm* — Michael Best & Friedrich LLP

(57) ABSTRACT

A sacrificial anode assembly. The sacrificial anode assembly includes a sacrificial anode, an insulator positioned around an end of the anode, an electric coupler positioned around the insulator and extending beyond the end of the anode, the electric coupler electrically isolated from the anode, a resistor having a first lead and a second lead, the first lead electrically connected to the anode and the second lead electrically connected to the electric coupler, and a cap positioned around the electric coupler, the cap electrically connected to the electric coupler and electrically isolated from the anode. The cap complete encapsulates the resistor, the first lead, and the second lead.

15 Claims, 10 Drawing Sheets

RESISTOR ANODE ASSEMBLY

BACKGROUND

Corrosion is an electrochemical process involving an anode, an electrolyte, and a cathode. When a piece of metal corrodes, the electrolyte provides charged hydrogen ions and hydroxide molecules to the metal. Corrosion occurs as the charged hydroxide ions combine with the metal, metallic hydroxides are created and metal is liberated into the electrolyte. Electrons are released into the metal by this reaction. A balancing cathodic reaction also occurs when the hydrogen ions flow through the electrolyte to the cathode, electrons are released from the metal and hydrogen gas is formed. These reactions involve a transfer of charge and therefore the sum of the electrons released by the corrosion of steel and aluminum (anodic reactions) must be consumed by the hydrogen evolution (cathodic reaction).

A cathodic protection system is implemented in water heaters to prevent corrosion of the water heater tank. The cathodic protection system includes an anode rod, which is electrically connected to the metal water heater tank. The anode rod is comprised of a metal, such as aluminum, magnesium, zinc, or other alloy that is more active than the metal tank of the water heater. The water heater tank is generally comprised of glass coated steel.

When water is introduced into the water heater tank, a galvanic circuit is created between the metal tank (and/or connectors) and the anode rod. As a result, electrical current flows from the anode, to the cathode, and ions flow through the water to complete the circuit between the anode and cathode, thus, the anode rod begins to corrode. The water supply may be modeled as a resistor within the electrical circuit. If the water supply has a high mineral content, the resistance through the water is low and current flow will increase, resulting in a corresponding increase in the consumption of the anode rod.

The addition of a resistor in the galvanic circuit can reduce the consumption time of the anode. Current resistored anodes, such as disclosed in U.S. Pat. Nos. 5,256,267 and 5,334,299 issued to Roden, are relatively difficult to assemble and the assembly is fragile. The exposed solder connection of the first lead of the resistor to the metal cap is susceptible to damage during installation in a water heater and during shipping and handling of the water heater and/or anode assembly. A fragile resistor connection can be broken, and can result in a loss of the connection of the anode to the water heater tank, resulting in accelerated corrosion failure of the water heater tank.

SUMMARY

In one embodiment, the invention provides a sacrificial anode assembly, including a sacrificial anode having an end, an insulator, an electric coupler, a resistor having a first lead and a second lead, and a cap. The insulator is positioned around the anode and the electric coupler is positioned around the insulator. The electric coupler extends beyond the end of the anode and does not have a direct electrical connection to the anode. The first lead of the resistor is connected to the anode and the second lead of the resistor is connected to the electric coupler. The cap is positioned around the electric coupler such that the cap has a direct electrical connection to the electric coupler and does not have a direct electrical connection to the anode.

In another embodiment the invention provides a method of making a resistor anode assembly, including positioning an insulator around an anode, positioning an electrically conductive element around the insulator, connecting a first lead of a resistor to the anode, connecting a second lead of the resistor to the electrically conductive element, and mounting an electrically conductive end cap over the electrically conductive element such that the electrically conductive end cap is electrically shorted to the second lead of the resistor but is not electrically shorted to the anode.

In another embodiment the invention provides a water heater, including a tank, a heating element to heat water in the tank, an inlet to add water to the tank, an outlet to withdraw water from the tank, and a sacrificial anode assembly electrically connected to the tank. The sacrificial anode assembly includes a sacrificial anode, an insulator positioned around an end of the anode, an electric coupler positioned around the insulator and extending beyond the end of the anode, the electric coupler not having a direct electrical connection to the anode, a resistor having a first lead and a second lead, the first lead connected to the anode and the second lead connected to the electric coupler, and a cap positioned around the electric coupler, the cap having a direct electrical connection to the electric coupler and not having a direct electrical connection to the anode.

Therefore, an advantage of the resistor anode assembly is that it is easier to manufacture and less susceptible to damage.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
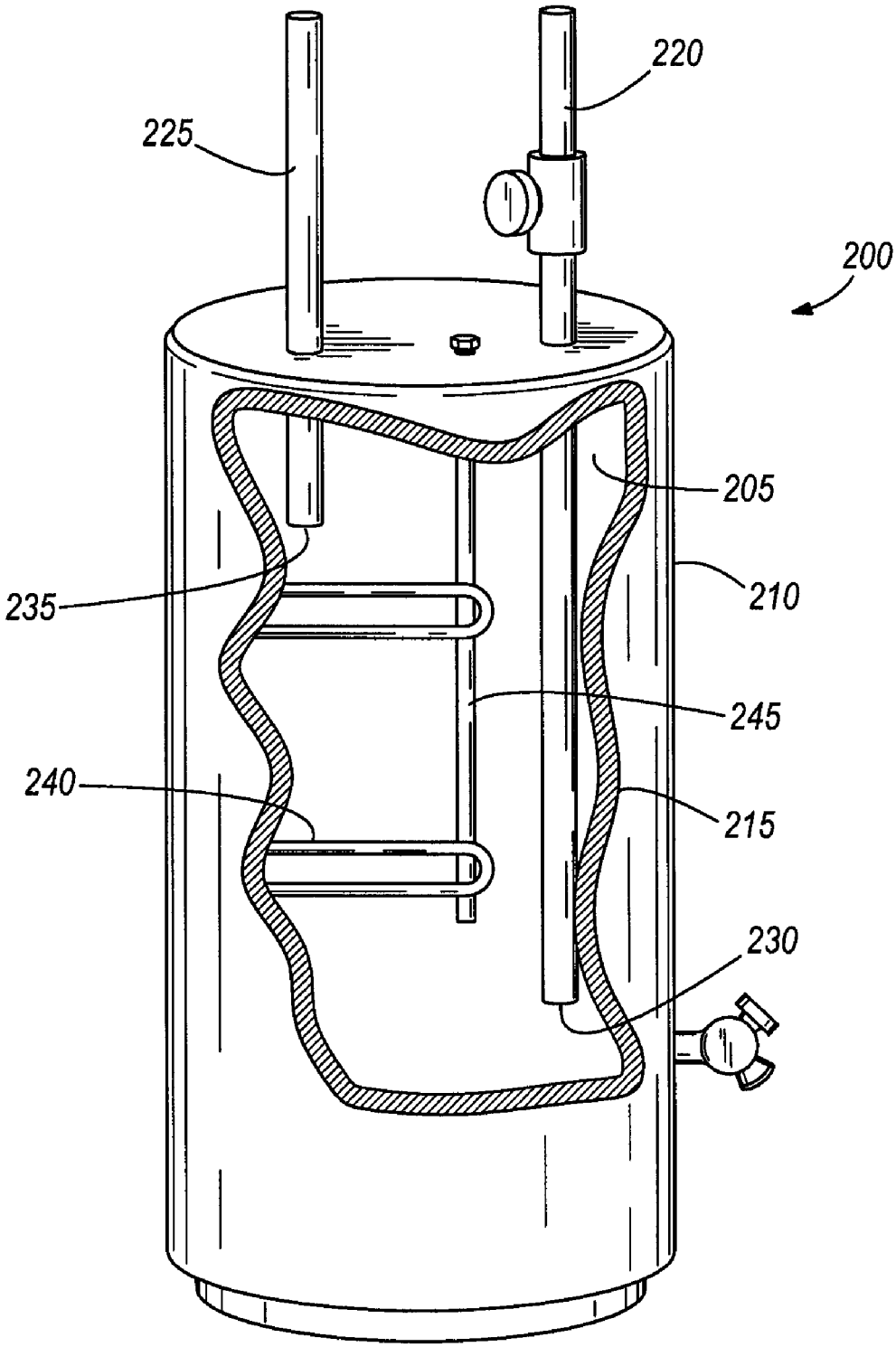
FIG. 1 is a cut-away perspective view of a water heater incorporating a resistor anode assembly.

FIG. 1 illustrates a water heater 200 including a permanently enclosed water tank 205, a shell 210 surrounding the water tank 205, and foam insulation 215 filling the annular space between the water tank 205 and the shell 210. A water inlet line 220 and a water outlet line 225 enter the top of the water tank 205. The water inlet line 220 has an inlet opening 230 for adding cold water near the bottom of the water tank 205. The water outlet line 225 has an outlet opening 235 for withdrawing hot water from near the top of the water tank 205. The water heater 200 also includes one or more resistance heating elements 240 that extend through a wall of the water tank 205, and a resistor anode assembly 245. While an electric water heater is shown, the invention can be used with other water heater types, such as a gas water heater, and with other water heater designs.

Figure 2:
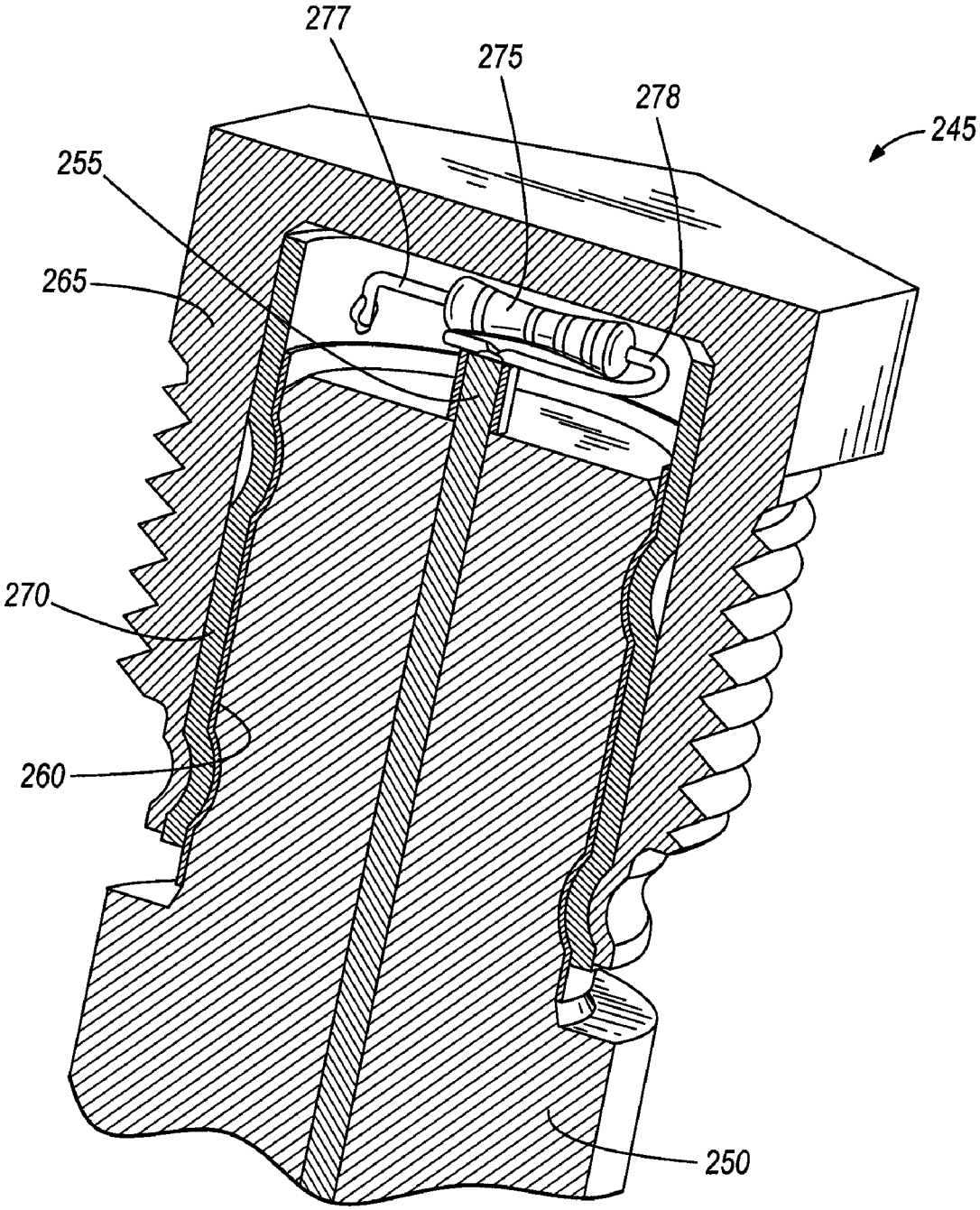
FIG. 2 is a cut-away view of a construction of the resistor anode assembly according to the invention.

FIGS. 2-8 illustrate the construction of the resistor anode assembly 245. As shown in FIG. 2, the assembly 245 includes a sacrificial anode 250 having a core wire 255, an insulator 260, a metal cap or mounting plug 265, an electric coupler 270, and a resistor 275 having a first lead 277 and a second lead 278.

Figure 3:
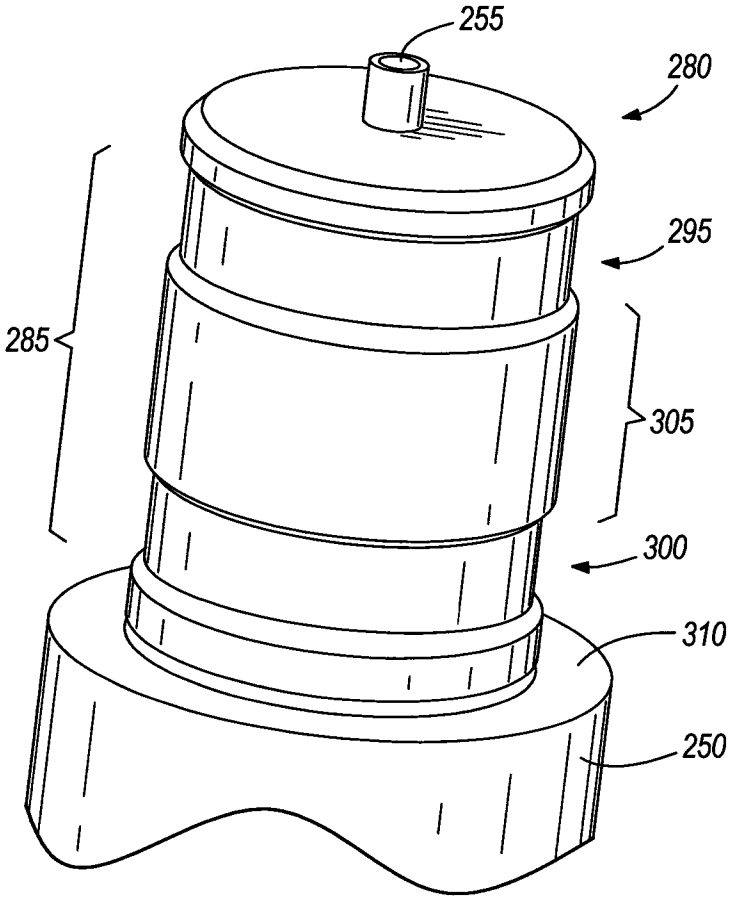
FIG. 3 is a perspective view of a construction of a machined end of a sacrificial anode according to the invention.

As shown in FIG. 3, a portion of the anode 250, adjacent the top end 280 of the anode 250, is processed (e.g., via machining) to expose a reduced diameter portion 285 of the anode 250. The core wire 255 extends through substantially the entire length of the center of the anode 250, and is electrically connected over that entire length to the anode 250. The core wire 255 also extends a distance beyond the top end 280 of the anode 250. The reduced diameter portion 285 of the anode 250 is further processed to create a first groove 295 and a second groove 300 separated by a center section 305. The reduced diameter portion 285 of the anode 250 forms a shoulder 310.

Figure 4:
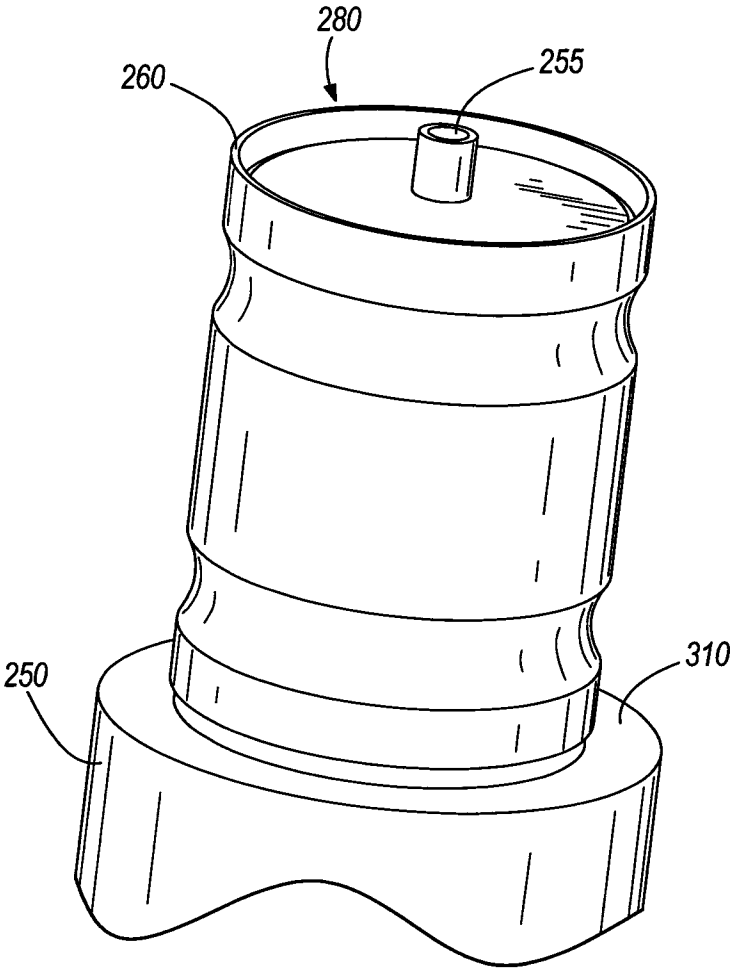
FIG. 4 is a perspective view of a construction of an insulator and anode of the resistor anode assembly according to the invention.

FIG. 4 illustrates the positioning of the insulator 260 on the anode 250. The insulator 260 can be constructed of a suitable material to electrically insulate the anode 250 from the electric coupler 270. In the construction shown, the insulator 260 is a heat-shrink plastic and the electric coupler 270 is a metallic cylinder. However, other insulators and electric couplers are contemplated. Insulators can include electrical tape and/or an organic coating, such as Teflon® or epoxy. For example, in some constructions, the insulator can be formed as an epoxy coating, either on a portion of the inside of a metal cylinder electric coupler or on the outside of the processed portion of the anode.

In the construction shown, the insulator 260 is placed over the reduced diameter portion 285 of the anode 250 extending from the shoulder 310 to a point past the top end 280 of the anode 250. The insulator 260 is then heated such that the insulator 260 shrinks to form fit around the reduced diameter portion 285 of the anode 250.

Figure 5:
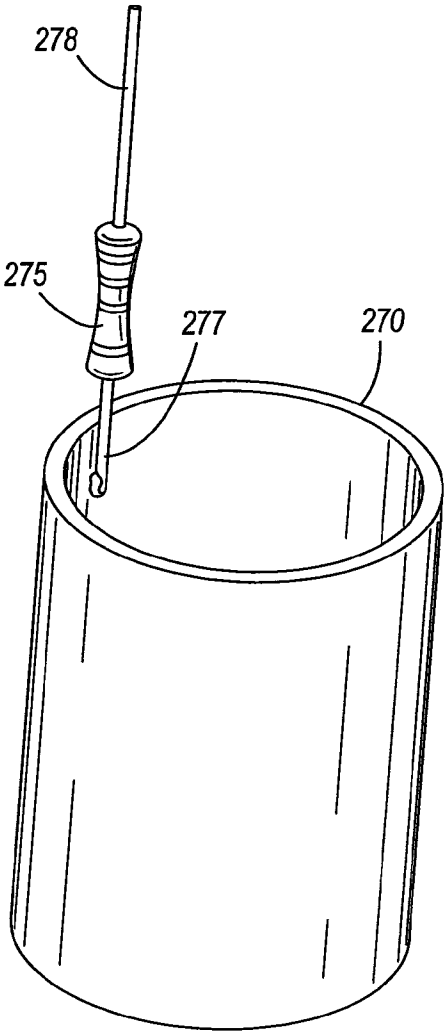
FIG. 5 is a perspective view of a construction of an electric coupler and resistor of the resistor anode assembly according to the invention.
Figure 6:
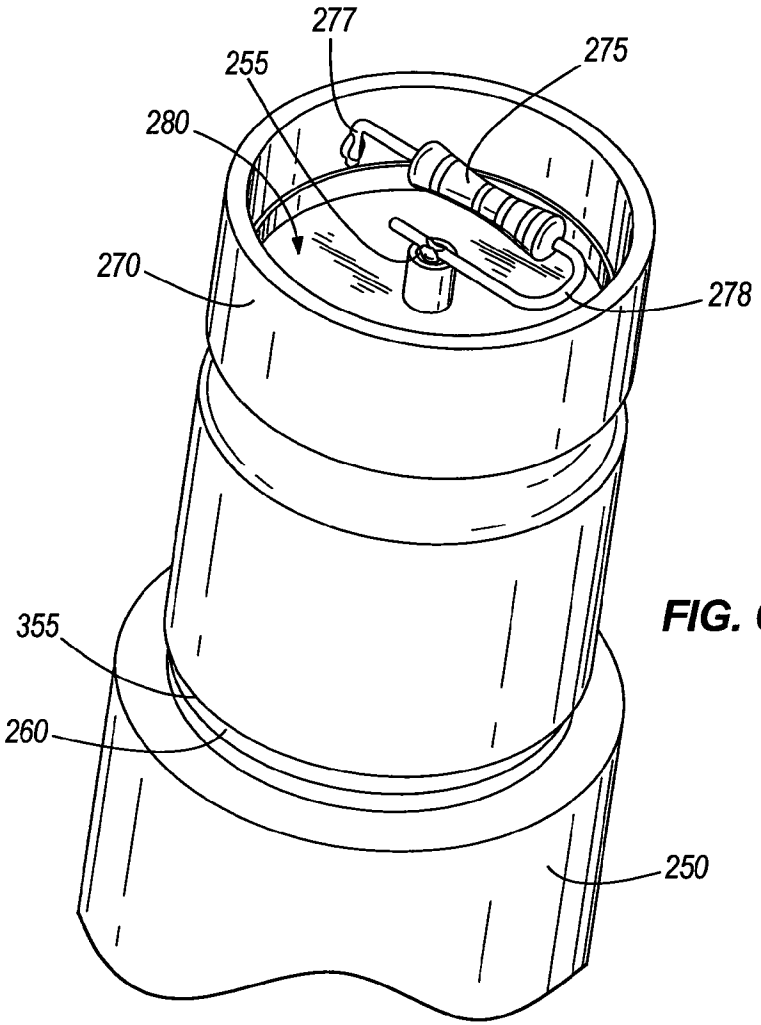
FIG. 6 is a perspective view of a construction of an assembly of the electric coupler and resistor of FIG. 5 mounted on the insulator and anode of FIG. 4 according to the invention.

FIG. 5 illustrates the connection of the first lead 277 of the resistor 275 to the electric coupler 270 (e.g., via soldering or welding). The connection creates an electrical and a physical connection between the resistor 275 and the electric coupler 270. As shown in FIG. 6, the electric coupler 270 is then positioned over the reduced diameter portion 285 of the anode 250 and the insulator 260 such that a bottom end 355 of the electric coupler 270 is spaced a distance from the shoulder 310 of the anode 250. This prevents a direct electrical connection (i.e., an electrical short) between the electric coupler 270 and the anode 250. The electric coupler 270 is then crimped into the first groove 295 of the anode 250 to hold the electric coupler 270 in place relative to the anode 250. In other constructions, the electric coupler 270 can be held in place by other suitable methods (e.g., an adhesive). The connection of the first lead 277 of the resistor 275 to the electric coupler 270 is also maintained a distance from the top end 280 of the anode 250 to prevent the first lead 277 of the resistor 275 from contacting the anode 250. The resistor 275 is then positioned parallel to the top end 280 of the anode 250, and the second lead 278 of the resistor 275 is connected (e.g., by soldering or welding) to the core wire 255 of the anode 250.

Figure 7:
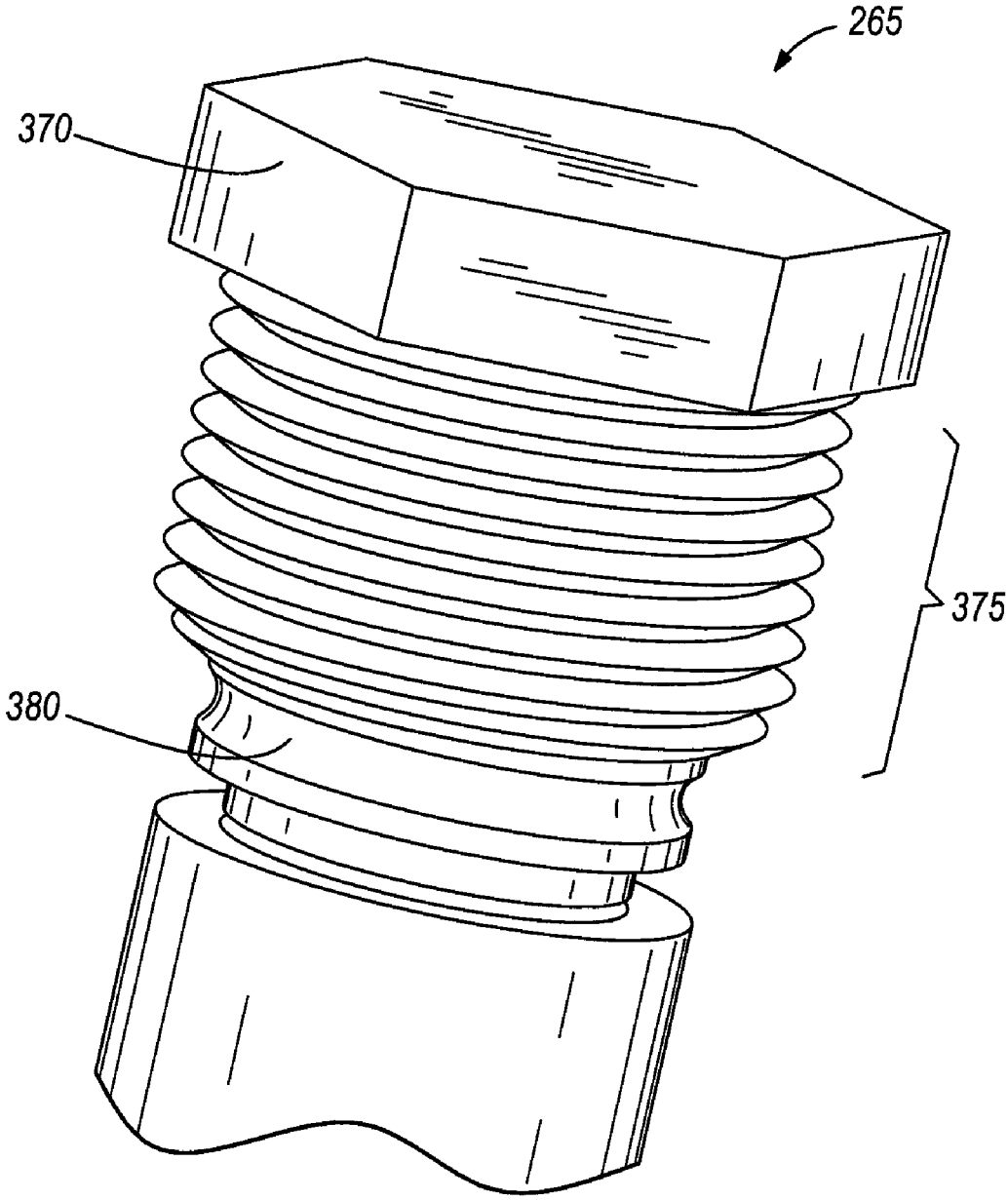
FIG. 7 is a perspective view of a construction of an end cap mounted on the assembly of FIG. 6 according to the invention.

As shown in FIG. 7, the metal cap or mounting plug 265 is then positioned over the electric coupler 270. In other constructions, the metal cap 265 can be constructed of another suitable, electrically conductive, material. In the construction shown, the metal cap 265 includes a polygonal shaped head 370, a threaded section 375, and a base section 380. The head 370 enables a tool, such as a wrench, to tighten the resistor anode assembly 245 to a water heater. The threaded section 375 is received in a threaded hole in the tank of the water heater. When the resistor anode assembly 245 is mounted to the water heater, the threaded section 375 of the cap 265 has a direct electrical connection to the tank of the water heater. The metal cap 265 is sized such that the base section 380 is positioned at the same height as the second groove 300 of the reduced diameter portion 285 of the anode 250. When the metal cap 265 is in position, the base section 380 is crimped into the second groove 300, along with the electric coupler 270, holding the metal cap 265 in place relative to the anode 250, and completely encapsulating the resistor 275, the first lead 277, and the second lead 278. The metal cap 265 thus has a direct electrical connection to the electric coupler 270 and to the first lead 277 of the resistor 275. In other constructions, the metal cap 265 can be held in place by other suitable methods (e.g., an electrically conductive adhesive).

When the resistor anode system 245 is installed in a water heater, the tank of the water heater and the metal cap or mounting plug 265 have a direct electrical connection. The tank and metal cap 265 also have a direct electrical connection, via the crimped base section 380, to the electric coupler 270. The electric coupler 270 has a direct electrical connection to the first lead 277 of the resistor 275, and the second lead 278 of the resistor 275 has a direct electrical connection to the anode 250.

Figure 8:
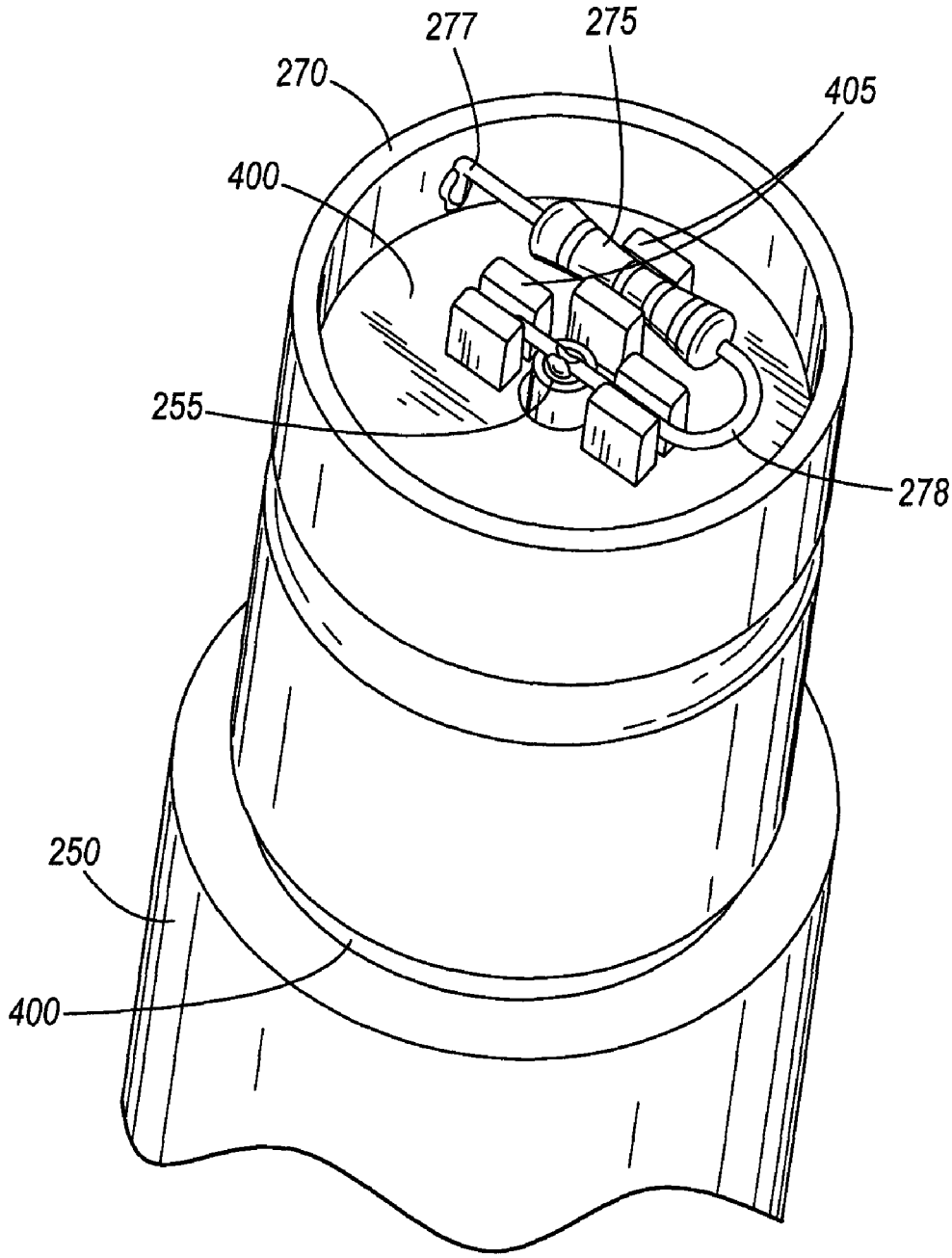
FIG. 8 is a perspective view of an alternative construction of the assembly of FIG. 6 according to the invention.

FIG. 8 shows an alternative construction of the resistor anode assembly 245. In the construction shown, the heat-shrink insulator 260 is replaced by an injection molded plastic cap 400. The plastic cap 400 can include bosses 405 which hold the resistor 275 and leads 277 and 278 in position. The bosses 405 can provide added support to the resistor 275 and further reduce the risk of damage to the resistor anode assembly 245 during handling and assembly.

Figure 9:
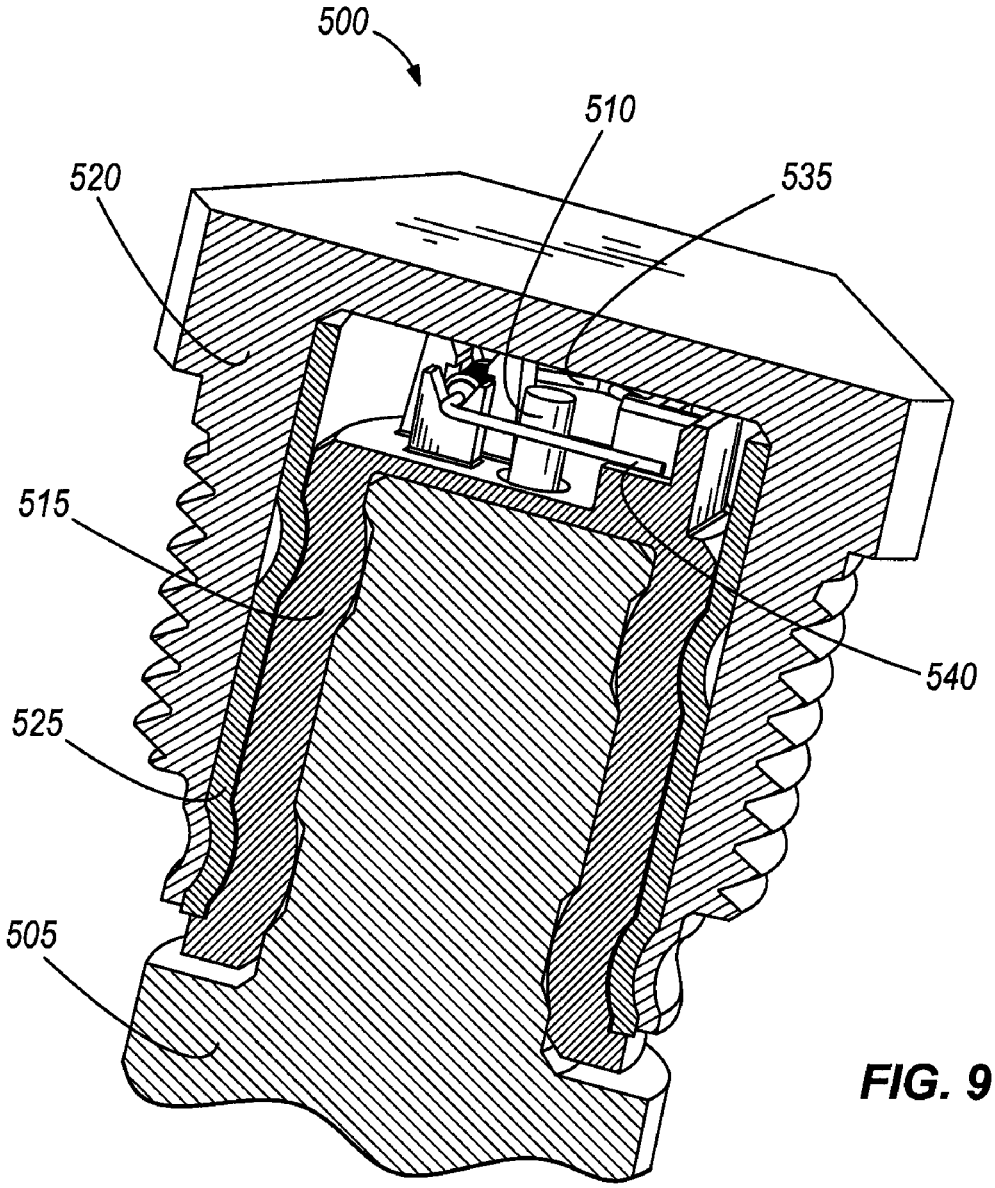
FIG. 9 is a cut-away view of another construction of a resistor anode assembly according to the invention.

FIGS. 9-12 illustrate another construction of a resistor anode assembly 500. As shown in FIG. 9, the assembly 500 includes a sacrificial anode 505 having a core wire 510, an insulator 515, a metal cap or mounting plug 520, an electric coupler 525, and a resistor 530 having a first lead 535 and a second lead 540.

Figure 10:
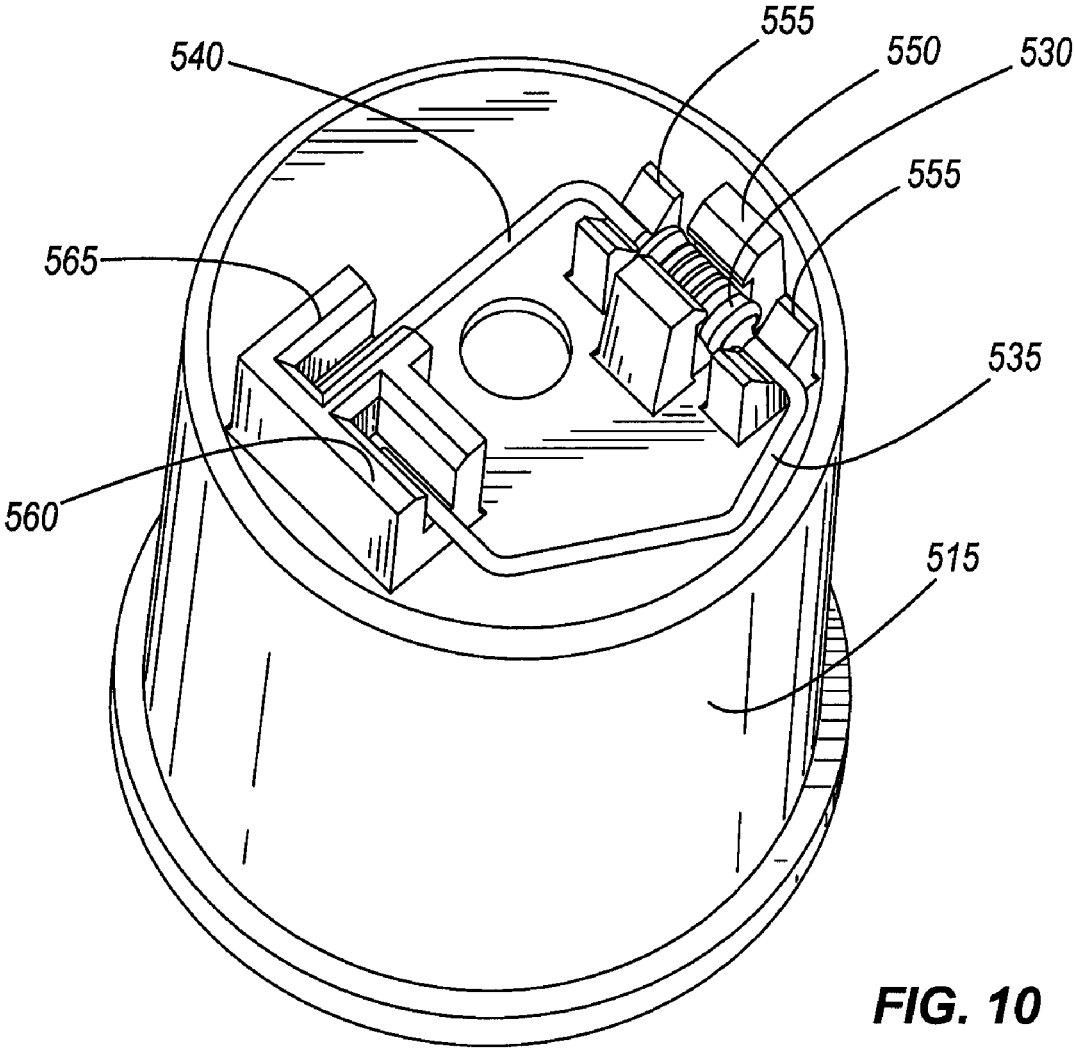
FIG. 10 is a perspective view of a construction of an insulator and a resistor of the anode assembly of FIG. 9.

FIG. 10 illustrates the construction of the insulator 515 and resistor 530. The insulator 515 is an injection molded plastic cap. The insulator 515 includes a pair of resistor holding bosses 550, a pair of support bosses 555, a first seat 560, and a second seat 565. The resistor holding bosses 550 are formed such that the resistor 530 can be snapped in place between the bosses 550 and held in place. The support bosses 555 provide support and aid in positioning the first and second leads 535 and 540 of the resistor 530. The first and second seats 560 and 565 receive ends of the first and second leads 535 and 540 respectively. The seats 560 and 565 help to maintain the position of the leads 535 and 540 proximate the electric coupler 525 and core wire 510 respectively. An adhesive, while not necessary, can be added to the seats 560 and 565 after the resistor 530 has been snapped into the bosses 550 to further hold the leads 535 and 540 in place.

Figure 11:
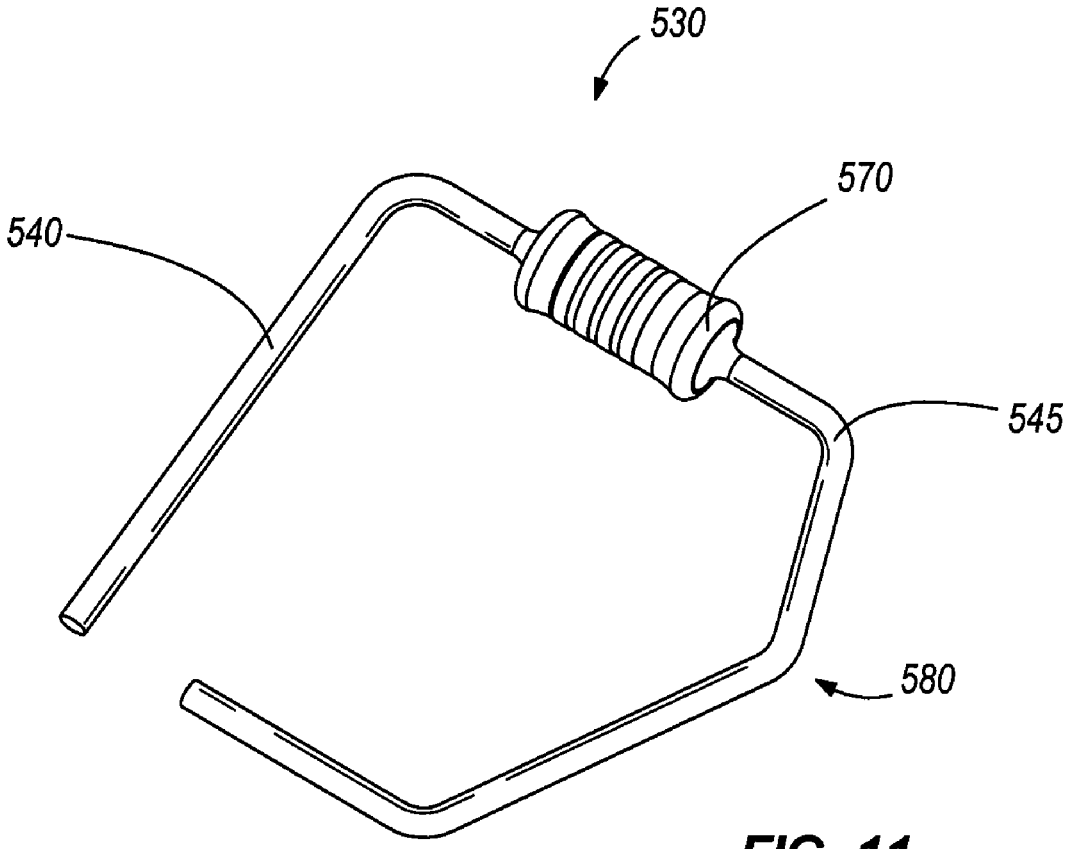
FIG. 11 is a perspective view of a construction of a resistor of the anode assembly of FIG. 9.

FIG. 11 shows a construction of the resistor 530. The resistor 530 is a barrel type resistor wherein the first lead 535 extends from one end of a barrel 570 and the second lead 540 extends from an opposite end of the barrel 570. The first lead 535 is formed as one-half of a hexagon. The second lead 540 is bent at 90 degrees. The first and second leads 535 and 540 are formed to lie in a single plane. While one construction of the resistor 530 has been described, other constructions of the resistor 530 are also contemplated.

Figure 12:
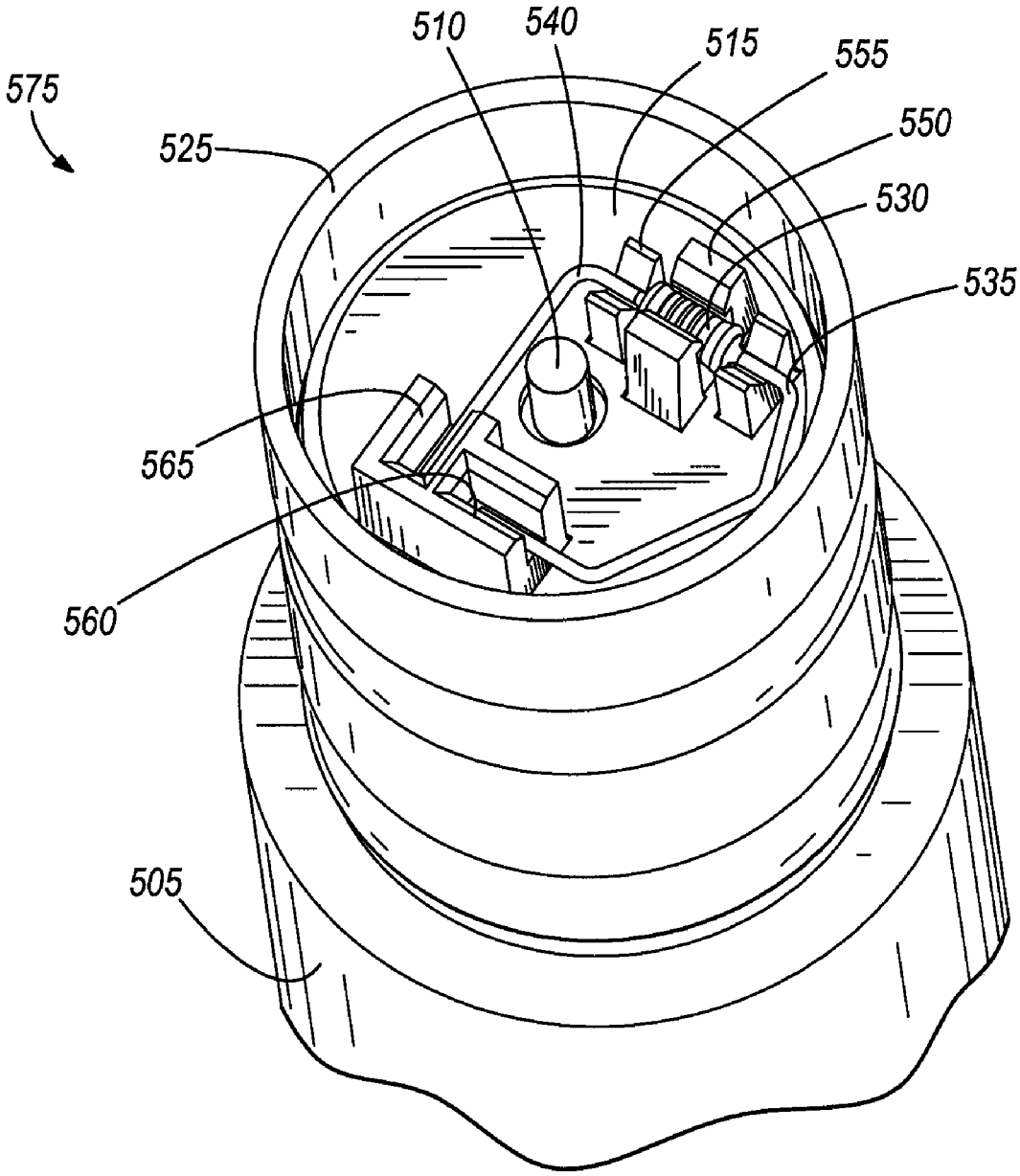
FIG. 12 is a perspective view of a construction of a subassembly of the anode assembly of FIG. 9.

FIG. 12 shows a construction of a sub-assembly 575 of the resistor anode assembly 500. The sub-assembly 575 includes the resistor 530, the insulator 515, the electric coupler 525, the anode 505, and the core wire 510. The barrel 570 of the preformed resistor 530 is snapped into the resistor holding bosses 550 of the insulator 515 with the ends of the first and second leads 535 and 540 positioned in the first and second seats 560 and 565, respectively. Optionally, an adhesive can be applied to the ends of the leads 535 and 540 resting in the first and second seats 560 and 565. The electric coupler 525 is then fit onto the insulator 515. The electric coupler 525 can be held in place on the insulator 515 by friction fit features, a taper shape of the insulator 515, or other suitable means. Next the insulator 515 is positioned on the anode 505. The electric coupler 525 is then mechanically formed (e.g., crimped) to the anode 505 to hold the insulator 515, the resistor, 530, and the electric coupler 525 in place on the anode 505, creating the sub-assembly 575. A portion 580 of the first lead 535 is positioned proximate the electric coupler 525, and the second lead 540 is positioned proximate the core wire 510. The positioning of the first and second leads 535 and 540 proximate the electric coupler 525 and core wire 510 respectively, in the sub-assembly 575, enables a welding machine to weld the first lead 535 to the electric coupler 525 and the second lead 540 to the core wire 510. Finally, the metal cap 520 is positioned over the sub-assembly and mechanically formed (e.g., crimped) to the anode 505.

Thus, the invention provides, among other things, a resistor anode assembly providing easier manufacturing and improved susceptibility to damage. Various features and advantages of the invention are set forth in the following claims.

What is claimed is:

1. A sacrificial anode assembly, comprising:

a sacrificial anode having an end;

an insulator positioned around the anode;

an electric coupler positioned around the insulator and extending beyond the end of the anode, the electric coupler not having a direct electrical connection to the anode;

a resistor having a first lead and a second lead, the first lead connected to the anode and the second lead directly connected to the electric coupler; and a cap positioned around the electric coupler, the cap having a direct electrical connection to the electric coupler and to the second lead, and not having a direct electrical connection to the anode;

wherein the resistor is enclosed within the electric coupler.

2. The sacrificial anode assembly of claim 1, wherein the insulator is constructed of a heat-shrink material.

3. The sacrificial anode assembly of claim 1, wherein the insulator is a non-conductive organic coating on the electric coupler.

4. The sacrificial anode assembly of claim 1, wherein the insulator is an injection molded cap.

5. The sacrificial anode assembly of claim 4, wherein the insulator includes a plurality of bosses, the bosses holding the resistor and the first and second leads in place.

6. The sacrificial anode assembly of claim 5, wherein the leads of the resistor are preformed such that a portion of the first lead is positioned proximate to a core wire extending beyond the end of the anode and a portion of the second lead is positioned proximate the electric coupler, the leads positioned to facilitate welding by a welding machine.

7. The sacrificial anode assembly of claim 1, wherein the anode includes a core wire extending beyond the end, the first lead soldered to the core wire.

8. The sacrificial anode assembly of claim 1, wherein the resistor and the first and second leads are completely encapsulated within the cap.

9. The sacrificial anode assembly of claim 1, wherein the anode includes a first groove and a second groove.

10. The sacrificial anode assembly of claim 9, wherein the electric coupler is crimped into the first groove.

11. The sacrificial anode assembly of claim 9, wherein the end cap is crimped into the second groove.

12. A water heater, comprising:

a tank;

a heating element to heat water in the tank;

an inlet to add water to the tank;

an outlet to withdraw water from the tank; and a sacrificial anode assembly electrically connected to the tank, the sacrificial anode assembly including a sacrificial anode, an insulator positioned around an end of the anode, an electric coupler positioned around the insulator and extending beyond the end of the anode, the electric coupler not having a direct electrical connection to the anode, a resistor having a first lead and a second lead, the first lead connected to the anode and the second lead directly connected to the electric coupler, and a cap positioned around the electric coupler, the cap having a direct electrical connection to the electric coupler and to the second lead, and not having a direct electrical connection to the anode, wherein the resistor is enclosed within the electric coupler.

13. The water heater of claim 12, wherein the resistor, the first lead, and the second lead are completely encapsulated in the cap.

14. The water heater of claim 12, wherein the cap includes external threads and is received in a threaded hole in the tank.

15. The water heater of claim 14, wherein the cap has a direct electrical connection to the tank.

* * * * *